US005987300A

United States Patent [19]

Mori

[11] Patent Number: 5,987,300

[45] Date of Patent: Nov. 16, 1999

[54] IMAGE FORMING APPARATUS PRINTING ON BOTH SIDES OF A PRINTING MEDIUM

[75] Inventor: Hiroshi Mori, Yamato, Japan

[73] Assignee: Ricoh Company, Ltd., Tokyo, Japan

[21] Appl. No.: 09/053,796

[22] Filed: Apr. 2, 1998

[30] Foreign Application Priority Data

Apr. 10, 1997 [JP] Japan ..... 9-092560

[51] Int. Cl.[6] ..... G03G 15/00; G03G 21/14

[52] U.S. Cl. ..... 399/401; 399/43; 399/87

[58] Field of Search ..... 399/401, 402, 399/397, 388, 364, 361, 87, 85, 43, 38, 16; 271/3.14, 8.1, 902; 395/115, 116; 358/296, 401, 498

[56] References Cited

U.S. PATENT DOCUMENTS

| | | | |
|---|---|---|---|
| 4,914,458 | 4/1990 | Mori et al. . | |
| 5,132,719 | 7/1992 | Kioka et al. | 399/361 X |
| 5,241,397 | 8/1993 | Yamada | 358/296 |
| 5,594,542 | 1/1997 | Sugimoto et al. | 399/402 |
| 5,596,389 | 1/1997 | Dumas et al. | 399/16 |
| 5,740,497 | 4/1998 | Yamada et al. | 399/87 |
| 5,812,907 | 9/1998 | Itoh et al. | 399/87 |
| 5,818,602 | 10/1998 | Nakajima et al. | 358/296 |

FOREIGN PATENT DOCUMENTS

| | | |
|---|---|---|
| 64-11272 | 1/1989 | Japan . |
| 64-69425 | 3/1989 | Japan . |
| 2-2581 | 1/1990 | Japan . |
| 2-171776 | 7/1990 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

An image forming apparatus includes a memory for storing image information. The image information stored in the memory can be printed onto both surfaces of paper sheets. A resupplying path guide sheets having information printed on a first surface thereof to a printer for subsequent printing on a second surface of the sheets. The resupplying path includes at least one standby position for suspending the sheets. Further, the total number of sheets introduced into the resupplying path can be controlled to ensure that no collision of sheets occurs. Further, such an operation can be intermitted by a further printing operation, and such a process can be executed prior to outputting sheets to a finishing device.

18 Claims, 16 Drawing Sheets

WHEN JUDGED THAT READING IMAGE DATA OF THE SECOND SURFACE OF THE SECOND SHEET DELAYS

IMAGE FORMING APPARATUS PRINTING ON BOTH SIDES OF A PRINTING MEDIUM

CROSS-REFERENCE TO RELATED APPLICATIONS

The present document incorporates by reference the entire contents of Japanese priority document 09-92560 filed in Japan on Apr. 10, 1997.

BACKGROUND OF THE INVENTION

1. Field of the Invention

The present invention relates to a device, such as a copy machine, a printer, a facsimile, etc., that can print on both sides of sheets, and more particularly, the present invention relates to such a device that includes a memory for storing digitized images.

2. Discussion of the Background

A background printing control method of a printer is disclosed in a Japanese Patent No. 2522799. In such a control method, a controller monitors a sheet supplying operation from a sheet supplying unit and from a sheet resupplying unit. The controller controls the operations such that a sheet remaining in the resupplying unit is preferentially supplied therefrom based on a supervisory result that the sheet supplying is not to supply a sheet. Further, sheets from the resupplying unit are turned around so that the contents of each of successive original documents are printed on a back or second surface of each sheet which has already been printed on a first or front surface, and as a result, sheets having images printed on both surfaces thereof are then formed and then ejected.

However, in this method of printing on the first surface and the second surface of sheets alternately, the apparatus cannot continuously feed and keep a number of sheets with their first surface printed on which exceeds a number of standby position(s) in the apparatus, and the apparatus also must print to sheets in a given order decided before printing.

Further, increasing the number of standby position(s) in the apparatus makes the apparatus larger. Furthermore, when the apparatus has image data under compression in a storage media, because of differences in decompression times corresponding to the amount of image data, a number of sheets having their first surfaces successively printed on cannot exceed the number of standby position(s).

Furthermore, when an irregular decompression or transcription of an image data arises, re-transferring of the image data is attempted, and then a printing timing is delayed or the re-transferring may not be accomplished well.

When the re-transferring is not executed after a time, an extra process is usually executed such that a waiting operation for outputting the image data is canceled and the sheet to be printed on is ejected without printing. However, feeding a number of sheets continuously in the re-supplying path which exceeds a number of standby position(s) results in prolonging a waiting time of outputting the image data, and consequently a sheet may collide with a sheet that is in a standby position, and a sheet jam may occur. The background control method also does not operate in an apparatus having a finisher device or which takes an interrupting function into account.

SUMMARY OF THE INVENTION

Accordingly, one object of the present invention is to provide a novel image forming apparatus having a controller for adjusting a number of sheets to be fed whenever necessary during continuous printing, and that can thereby print to both surfaces of sheets with efficiency.

Another object of the present invention is to provide a novel image forming apparatus which can prevent the colliding of sheets when operating in a both surfaces printing mode.

Yet another object of the present invention is to provide a novel image forming apparatus having an interrupting function and that can print to both surfaces of a sheet with efficiency.

Still another object of the present invention is to provide a novel image forming apparatus having a finishing device, and which includes a controller for adjusting a number of sheets to be fed whenever necessary during continuous printing, and that can print to sheets on both surfaces thereof with efficiency.

DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
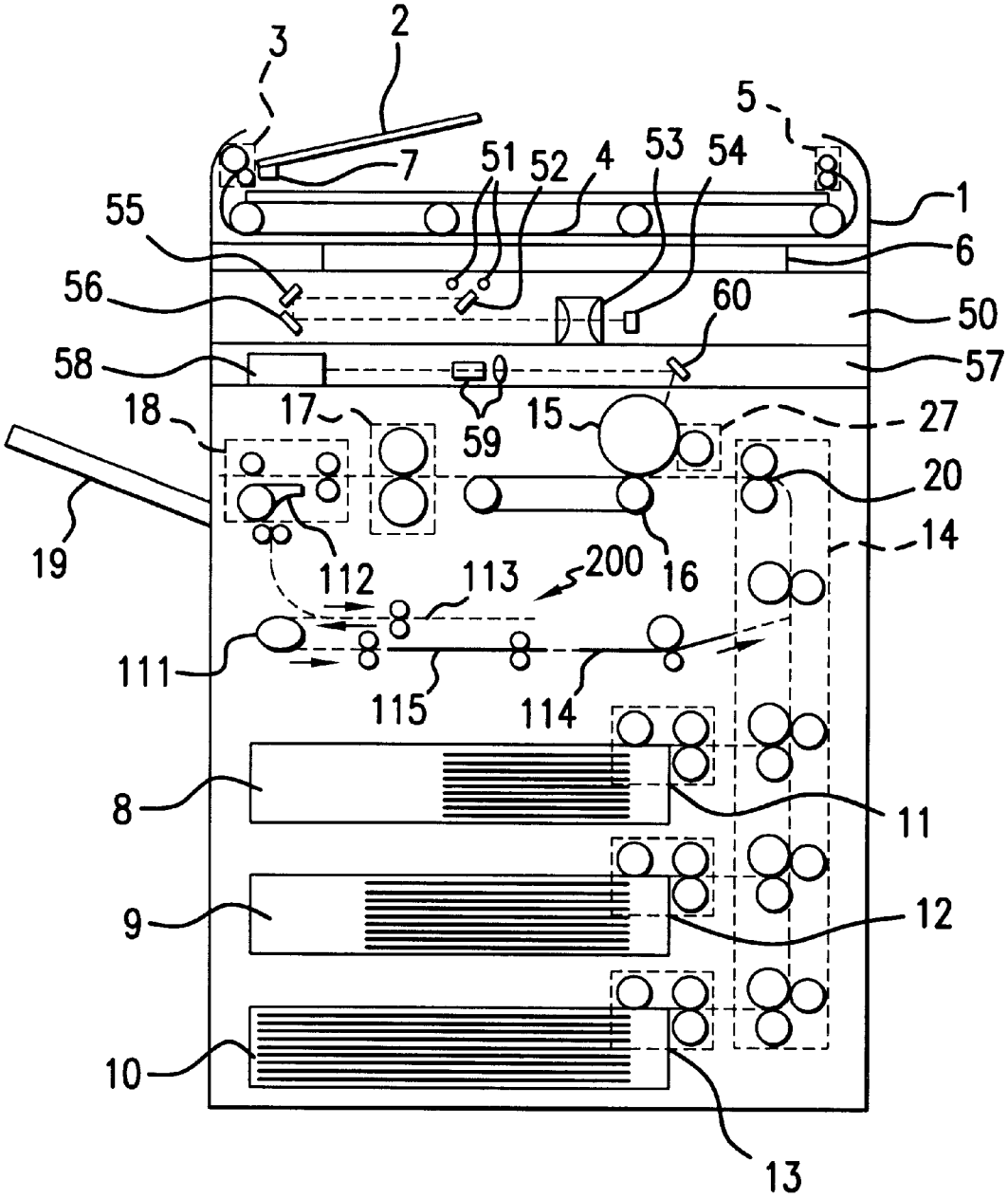
FIG. 1 is an outline construction figure of an embodiment of the present invention.
Figure 2:
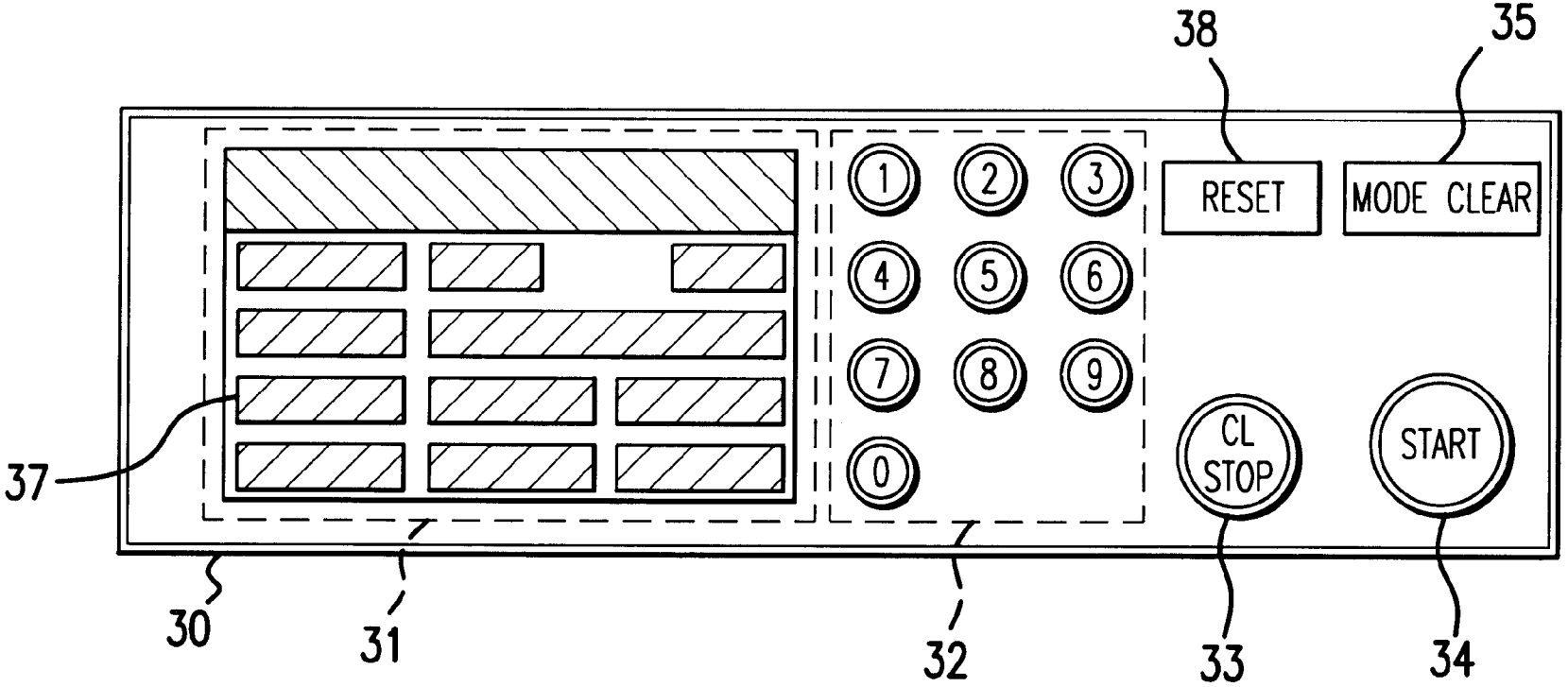
FIG. 2 is a figure showing an operation panel of the present invention.

FIG. 1 is an outline construction of an image forming apparatus according to the present invention. A stack of original documents are carried on a document board 2 equipped in an automatic document feeder 1 (ADF). As also shown in FIG. 2, when a start-key 34 located in an operation part 30 is pushed, the bottom document of the stack of original documents is moved to a reading position on a contact glass 6 by supplying rollers 3 and supplying belt 4.

An image on the original document on the contact glass 6 is read (scanned) at a reading unit 50, and the original document is then discharged by the supplying belt 4 and discharging rollers 5. Furthermore, a sensor 7 detects whether any further original document remains on the board 2 or not, and when the sensor 7 detects the existence of a further original document on the board 2, a next bottom original document is moved similarly. The supplying rollers 3, supplying belt 4, and discharging rollers 5 are driven by a conveyance motor 26, see FIG. 4 also.

Sheets held in a first tray 8, a second tray 9, and a third tray 10 are supplied to a photosensitive drum 15 by a respective first sheet supplying device 11, a second sheet supplying device 12, and a third sheet supplying device 13, each through a vertical supplying unit 14. The above-mentioned image data read by the reading unit 50 is written on the photosensitive drum 15 by a laser beam generated from a writing unit 57, and after passing through a developing unit 27, the image data is changed to a visible image with toner. A sheet reaching the photosensitive drum 15 is transported by a conveyance belt 16 at a same rotational speed of the photosensitive drum 15, and the visible image is then transferred from the photosensitive drum 15 to the sheet. Afterward, a fixing device 17 fixes the visible image of toner to the sheet, and the sheet is then discharged to a discharge tray 19 by a discharging unit 18.

In the vertical supplying unit 14, transportation of a sheet proceeds from a resisting roller 20 located before the photosensitive drum 15 matched with a writing timing of the image data to the photosensitive drum 15. In this situation, when the transportation of the image data to a first storing device is delayed, the writing timing is delayed, and consequently the sheet is stopped in a waiting position before the resisting roller 20. When this waiting time exceeds a predetermined time period, the waiting sheet is usually discharged without printing as an irregular condition.

To print on a second surface of a first sheet, the sheet is supplied from trays 8, 9, or 10, and then the sheet passes through the photosensitive drum 15 and fixing device 17 and is then transferred to a reverse unit 113 for turning the sheet around, i.e., reversing the front-end and back-end of the sheet. The sheet in this operation is not sent to the discharging tray 19 because of an upward setting of a selector 112 for selecting a path of the sheet. Afterward, the sheet is transferred to an intermediate tray 111. In this situation, there is another following sheet to be printed on, and as a result the first sheet is stopped at a first standby position 114 or at a second standby position 115, which standby positions 114, 115 are located in a resupplying path 200, until getting a permission for resupplying. The first sheet, then, starts to be transferred to the photosensitive drum 15 again in order to print on a second surface of the first sheet. The selector 112 is set downward and the first sheet is then transferred to the discharging tray 19 after printing on the second surface thereof. In this way, the intermediate tray 111 is used for printing to a sheet on both-sides thereof.

Figure 4:
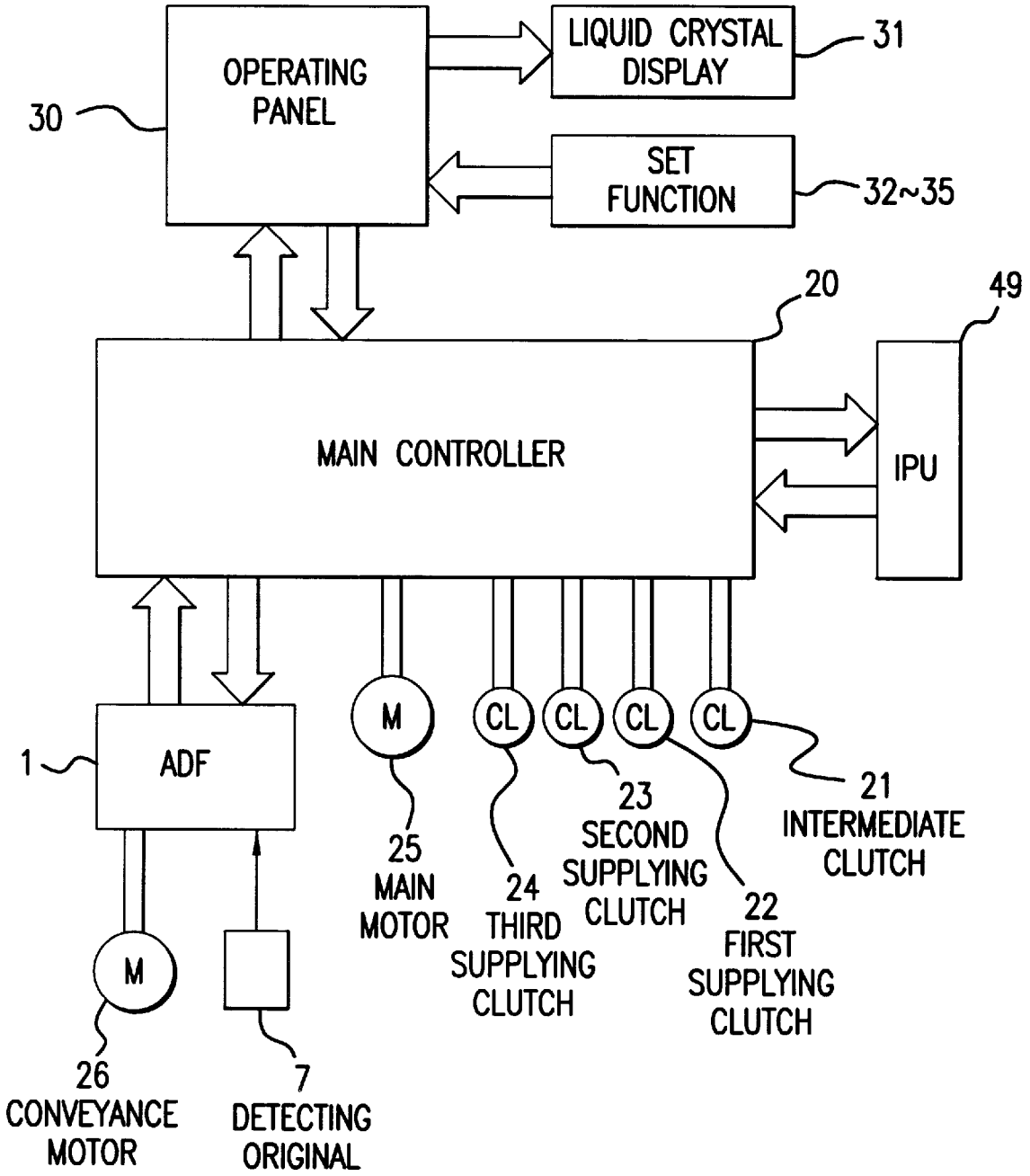
FIG. 4 is a block diagram showing a control device of the present invention.

The photosensitive drum 15, the conveyance belt 16, the fixing unit 17, the discharging unit 18, and the developing unit 27 are all driven by the main motor 25, see also FIG. 4. Each supplying unit 11, 12 and 13 is also driven by the main motor 25 each through supplying clutches 22, 23, and 24. The vertical supplying unit 14 is driven by the main motor 25 thorough an intermediate clutch 21.

An operating panel 30, as shown in FIG. 2, has a touchable liquid crystal display 31, a 10-button keypad 32, a clear/stop key 33, a printing key 34, a mode clear key 35, and a reset key 38. The touchable liquid crystal display 31 has a function key 37 for mode setting, and various kinds of messages, e.g. the number of printings, conditions of the machine, etc., are shown on the display 31.

Figure 3:
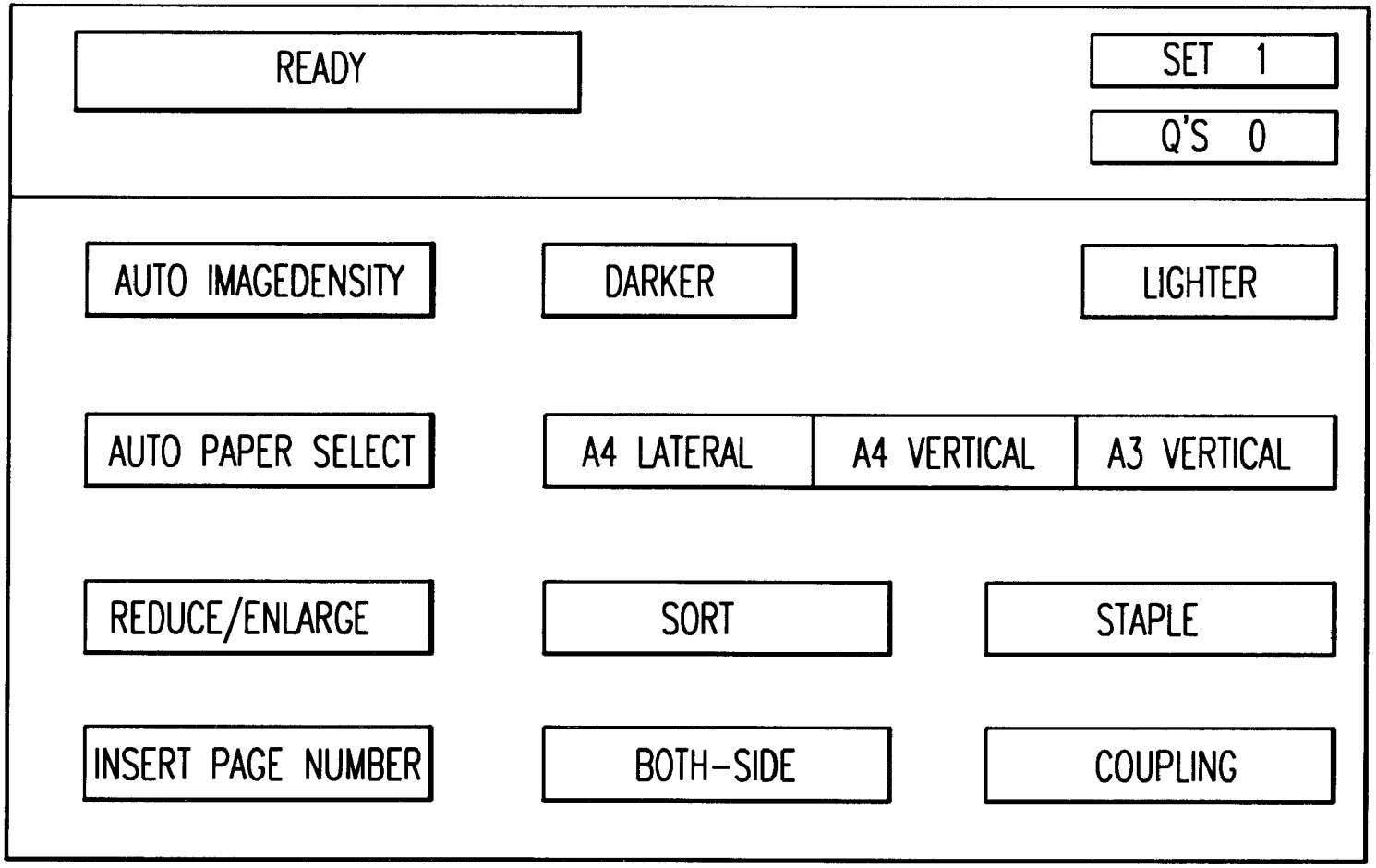
FIG. 3 is a figure showing a screen of a liquid crystal display of the present invention.

FIG. 3 shows an example of a screen of display 31. As shown in FIG. 3, when a operator pushes a key in the display 31, the key is displayed in inverse video and the function allocated to the key is selected. Selecting detail data, e.g. a scaling value of a scaling function, once an operator pushes a key, e.g., scaling key, a screen regarding the function, e.g., the scaling function, appears. The touchable liquid crystal display 31 can display a suitable screen in various conditions by using a dot-display device. Various messages, e.g. "ready", "wait", etc., can be shown at an upper-left of display 31 in FIG. 3, and a volume of a copy set can be shown at an upper-right of the display 31. At a lower part in the display 31, an auto image density key for adjusting image concentrations automatically, an automatic sheet select key for selecting a best matching size of sheets automatically, a sort key for sorting printed sheets each copy, a stack key for sorting printed sheets each page, a staple key for stapling the sorted sheets, an equal key for setting a printing scale equally, a scaling key for setting a printing scale variously, a both side key for setting a both-sided printing mode, and a coupling key for dividing many printing operations into plural parts and printing out through network of digital device, etc., can be shown. The display 31 displays suitable screens based on selections of the above-mentioned function keys.

FIG. 4 is a block diagram of a control device including a main controller 20. The main controller 20 is connected to the operation panel 30 for setting various functions and for showing various information to an operator, and the main controller 20 is connected to an image-processing unit (IPU) 49 for controlling a scanner and for controlling writing image data to an image memory and for controlling formation of the image data from the image memory. The main controller 20 also controls dispersive devices, e.g. auto document feeder (ADF) 1. A check of a device condition or a connection condition of the dispersive devices is regularly executed by the main controller 20. Furthermore, the main controller 20 is connected with main motor 25 and conveyance motor 26 for feeding sheets and controlling clutches 21, 22, 23, and 24.

An image forming process executed in the present invention is now explained.

The reading unit 50 includes contact glass 6 for supporting an original document and a scanning part. The scanning part includes an exposure lamp 51, a first mirror 52, a lens unit 53, a CCD image sensor 54, a second mirror 55, and a third mirror 56. The exposure lamp 51 and the first mirror 52 are secured with a first carriage (not shown). The second mirror 55 and the third mirror 56 are secured with a second carriage (not shown). When scanning the original document, the first carriage and the second carriage are moved at a ratio velocity of 2:1 to maintain a length therebetween. A scanning motor (not shown) drives the scanning part.

An image of the original document is read by the CCD image sensor 54 and is converted from lightwave signals to electric signals to be processed. As the CCD image sensor and the lens 53 move toward the right or left direction in FIG. 1, a scaling value of the image is changed. The CCD image sensor 54 and the lens 53 are moved until reaching a position corresponding to a selected scale value.

A writing unit 57 includes a laser unit 58, a gathering lens 59, and a mirror 60. The laser unit 58 has a diode as a light source and a polygonal motor spinning rapidly inside. A laser beam generated from the laser unit 58 is polarized by the polygonal mirror and is folded back by the mirror 60 through the gathering lens 59 and then impinges on the photosensitive drum 15. The polarized laser beam is exposed along an intersecting direction of a rotational direction of the photosensitive drum 15, i.e., a main scanning direction. An image signal output from an output selector is then recorded in increments of one line. By repeating the above-noted exposure in cycles in regard to a rotational speed and printing density, an electrostatic latent image can be formed on the photosensitive drum 15.

A beam sensor (not shown) for generating a line-synchronizing signal is placed at a portion exposed in proximity to an edge of the photosensitive drum 15. Based on the line-synchronizing signal, a printing timing in the main scanning direction is controlled and a control signal for the input/output of an image signal is generated.

Figure 5:
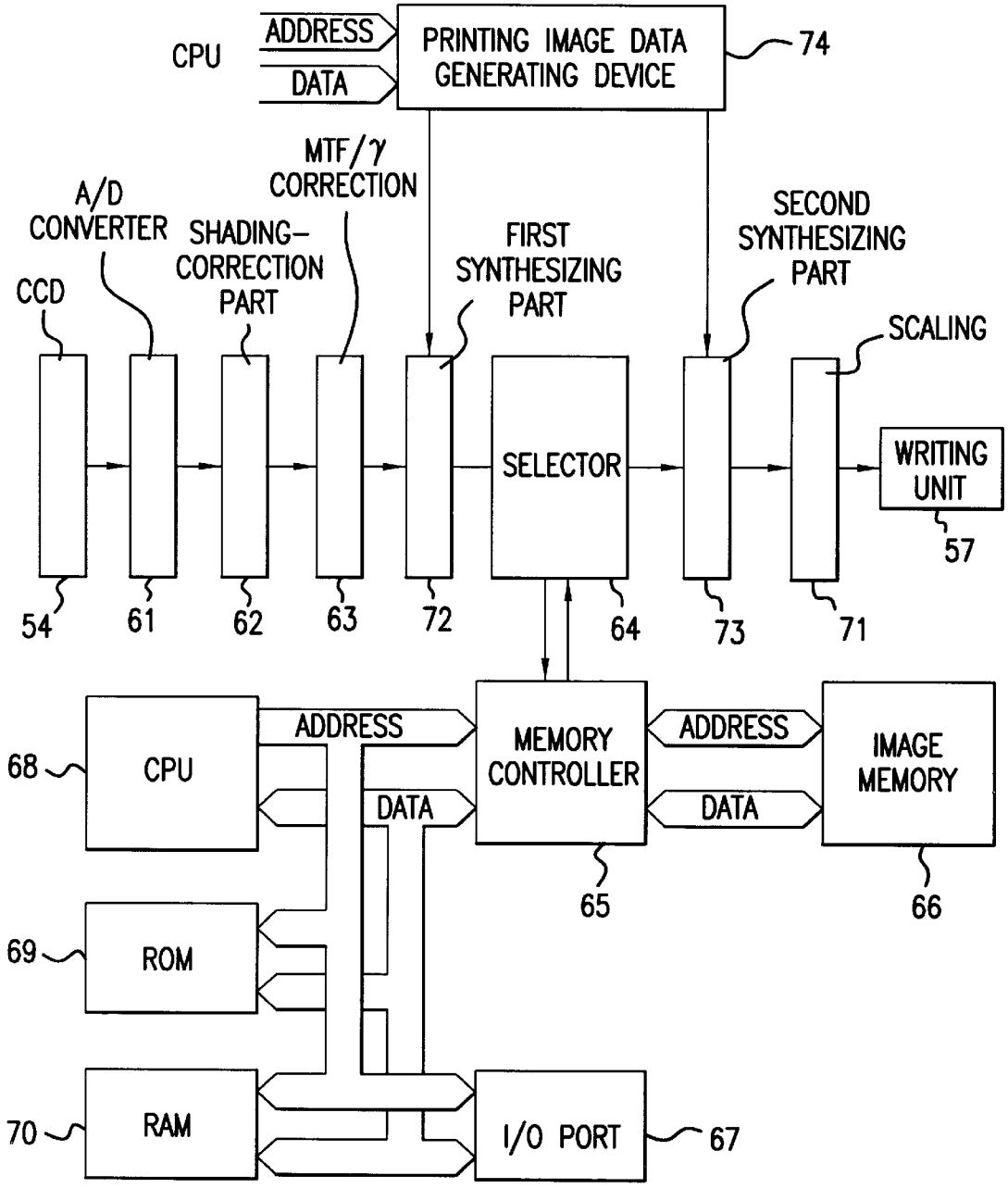
FIG. 5 is a block diagram showing an IPU of the present invention.

Referring to FIG. 5, the image-processing unit (IPU) 49 is explained. Light generated by the exposure lamp 51 is exposed to a surface of the original document and is reflected therefrom. The reflected light is incident to a light-receptive surface of the CCD 54 and is converted opto-electronically, and is then converted to digital signals by an A/D converter 61. Shading-correction is executed to the digitized image signal at a shading-correction part 62, and then MTF-correction and γ-correction are executed at an image processing part 63. At a selector 64, a destination to which a digitized and corrected image signal is to be sent is chosen between a scaling part 71 side and a memory controller 65 side. The image signals sent to the scaling part 71 are magnified or reduced matching a selected scale percentage and are then further sent to the writing unit 57. Both the image memory controller 65 and the selector 64 can input/output image data to each other.

The IPU 49 has a function to select the input/output of plural image data in order to handle data supplied from extra devices. As the extra data, for example as shown in FIG. 5, data can be output from a printing image data-generating device 74 such as a personal computer. Such data is synthesized at a first synthesizing part 72 and at a second synthesizing part 73. In this embodiment, the data is synthesized with the data supplied from the processing part 63 at the first synthesizing part 72, or is synthesized with data next sent to the scaling part 71 at the second synthesizing part 73.

The IPU 49 includes a ROM 69 and a RAM 70 holding programs and data for sending to the image memory controller 65, and a CPU 68 controlling the reading unit 50 and the writing unit 57. The CPU 68 can read data from and write data to the image memory 66 through the image memory controller 65. These parts can communicate to extra parts, e.g., printing image data generating device 74, through an I/O port 67.

Figure 6:
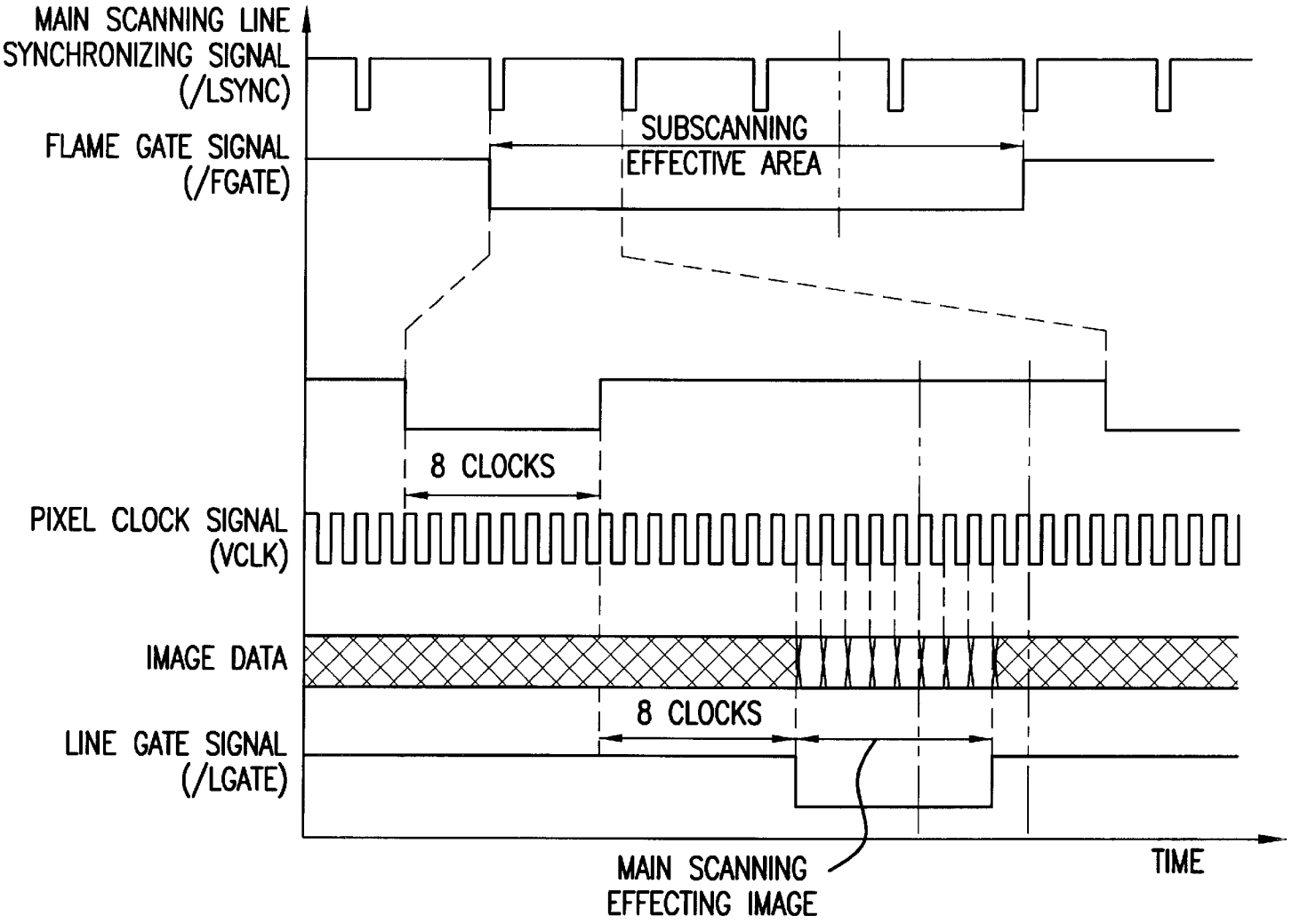
FIG. 6 is a timing chart figure showing a timing of selections of image signals in the present invention.

Referring to a timing-chart in FIG. 6, image signal processing with respect to selector 64 is explained.

A concave-shaped range of a flame gate signal (/FGATE) shows an effective period of image data of one page in a sub-scanning direction. A main scanning line synchronizing signal (/LSYNC) is a synchronizing signal of a main scanning line, and image data changes are effective during a predetermined clock after the (/LSYNC) signal trigger. A concave-shaped range of a line gate signal (/LGATE) shows that an image signal in the main scanning direction is effective. The above-mentioned signals are in synchronization with a pixel clock signal (VCLK), and one pixel data is sent every one periodicity of (VCLK). The IPU 49 includes a generating mechanism for generating these signals (/FGATE), (/LSYNC), (/LGATE), and (VCLK).

Figure 7:
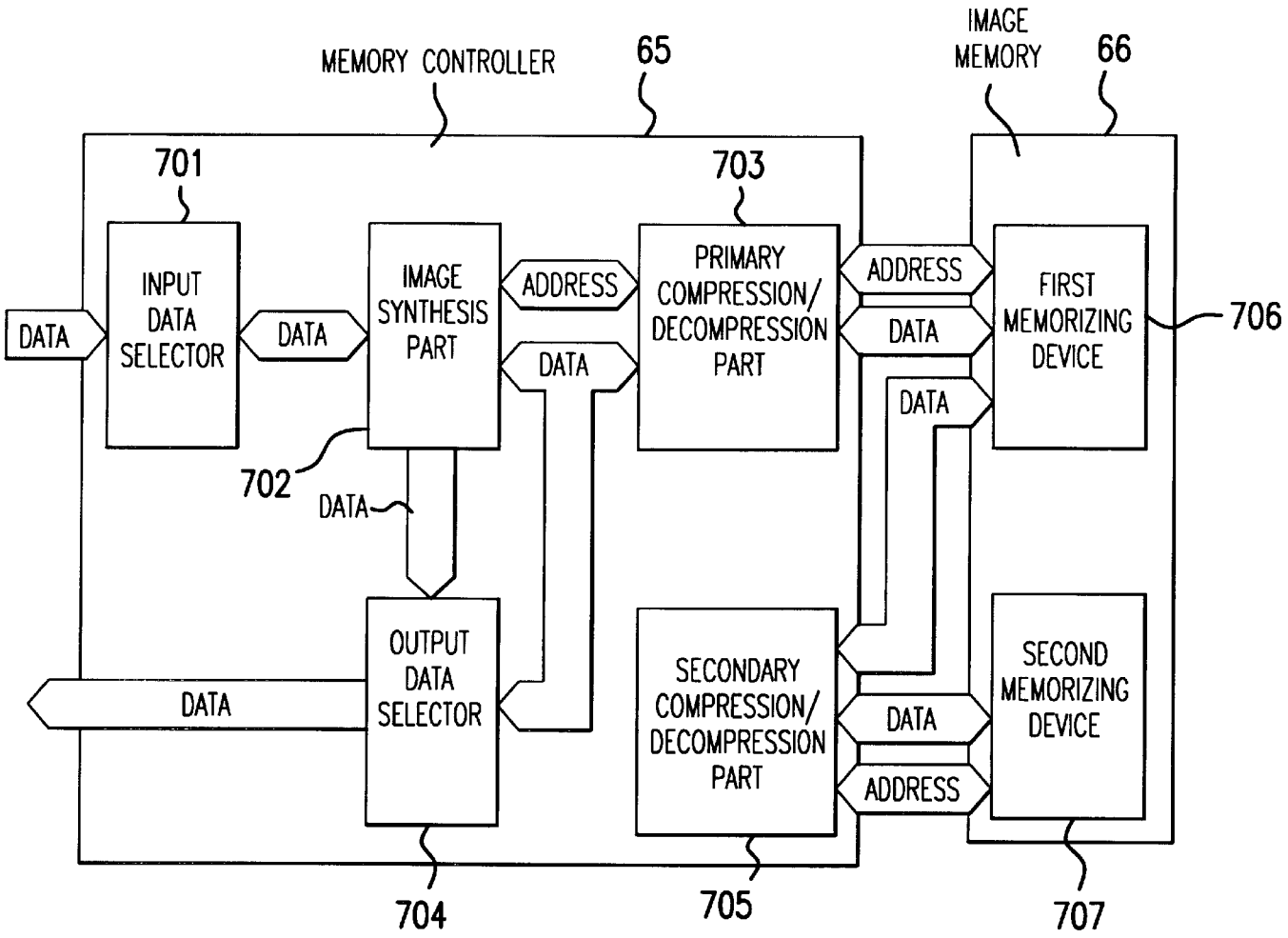
FIG. 7 is a block diagram of a memory controller and an image memory of the present invention.

Referring to FIG. 7, the memory controller 65 and image memory 66 illustrated in FIG. 5 are further explained. The memory controller 65 includes an input data selector 701, an image synthesis part 702, a primary compression/decompression part 703, an output data selector 704, and a secondary compression/decompression part 705. Setting control data for each part is executed by CPU 68. Address and data, as shown in FIG. 7, means data regarding the image. Addresses and data for connecting to the CPU 68 are not shown. The image memory 66 includes a first memorizing device 706 and a second memorizing device 707. The first memorizing device 706 is writable and readable at high velocity, e.g., a DRAM dynamic random access memory, in synchronization with a transporting speed of input image data.

The first memorizing device 706 is divided into plural areas in response to a size of the image data, and an execute input and output simultaneously. That is to say, the image data is input to and output from first memorizing device 706 in parallel in each of divided areas, because two sets of data lines, as an interface, for writing and reading connect the memory controller 65 to the image memory 66. Accordingly, for example, in first memorizing device 706 reading data from an area 2 is possible while writing data to an area 1.

The second memorizing device 707 is a mass storage memory for keeping data for sorting and synthesizing. By utilizing chips that can be accessed at high velocity for both the first memorizing device 706 and the second memorizing device 707, processing and controlling the data can be easily executed without distinction of both memorizing devices.

In this embodiment, as a high performance chip, e.g., a DRAM, is so expensive, a cheap and mass storage memorizing media can be adopted for the second memorizing device 707, and the input and output of data in the second memorizing device 707 can be handled through the first memorizing device 706. Accordingly, the apparatus can deal with high-volume data with a simple and inexpensive construction.

Functions of the memory controller 65 are divided between the input of image data and the output of image data. Each function will now be explained separately.

1. Input of image data (memorizing image memory).

The input data selector 701 selects image data for writing to the image memory (the first image memorizing device 706) from among plural data. The selected image data is supplied to the image synthesis part 702 for synthesizing the image data with any other data which has already been supplied in, e.g., from the printing image data generating device 74, as necessary. The image data that is synthesized by the image synthesis part 702 is then compressed at the primary compression/decompression part 703 and is then written into the first memorizing device 706. The image data memorized is, as necessary, compressed at the second compression/decompression part 705 and is then memorized and stored in the second memorizing device 707.

2. Output of image data (reading from image memory).

Image data stored in the first memorizing device 706 is read when the image data is output for printing. When the image data is memorized in the first memorizing device 706, the image data is decompressed at the primary compression/decompression part 703 and is synthesized, as necessary, with any input image data at the image synthesis part 702, and the data is selected for outputting from the memory controller 65 at output data selector 704, and the selected data is then output. The image synthesis part 702 is a part where image data memorized in the first memorizing device 706 and input data are synthesized, and where an output destination of synthesized image data is selected. When synthesizing, a phase of the image data is adjusted, and when selecting, the image data is output to the output data selector 704 and/or the first memorizing device 706 simultaneously.

When the image data is memorized in the second memorizing device 707, i.e., not in the first memorizing device 706, the image data is decompressed at second primary compression/decompression part 703 and the data is dialed along the above-mentioned process after once written into the first memorizing device 706.

Figure 8A:
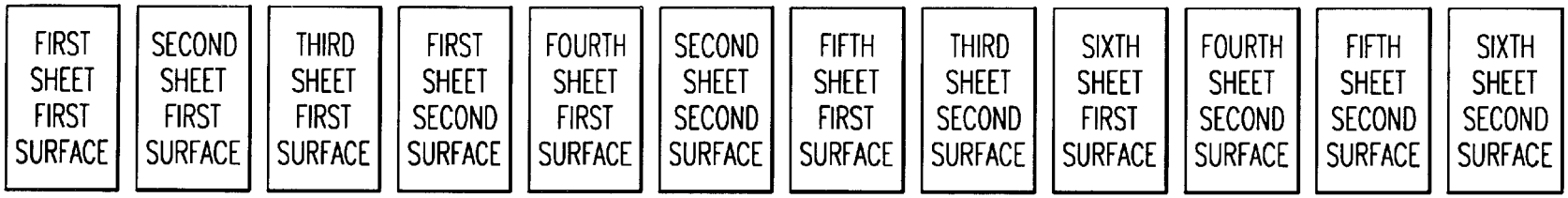
FIGS. 8(*a*) and 8(*b*) are explanation figures showing a both-sided printing sequence in an embodiment of the present invention.
Figure 8B:
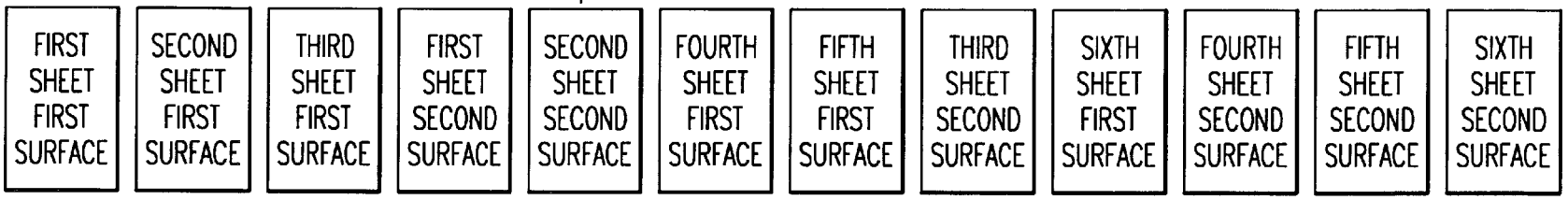

FIGS. 8(*a*) and 8(*b*) are explanation figures of a both-sided printing sequence with respect to this embodiment of the present invention. In the present invention a number of standby positions (N2: fixed-value) for suspending a sheet for printing on a second surface of the sheet are two, see standby positions 114, 115 in FIG. 1. "P (fixed-value)" shows a maximum number of sheets that the apparatus can hold inside, which is three (this includes a sheet currently being printing on) in this embodiment. N1 (a variable value) indicates a value of (a number of printing requests for printing on a first surface of a sheet) minus (a number to printing requests for printing on a second surface of a sheet). In the example shown in FIG. 8 a total number of sheets for printing is six. The sequence in FIG. 8(*a*) shows an operation under a high-speed printing mode, and the sequence in FIG. 8(*b*) shows an operation under a low-speed printing mode from a halfway point. The operation in the present invention switches from the high-speed printing mode of FIG. 8(*a*) to the low-speed printing mode of FIG. 8(*b*) if it is determined that a reading of image data is delayed and a collision of sheets may occur in the high-speed printing mode.

In the sequence shown in FIG. 8(*a*), a first side of first, second and third sheets are printed on, and then a second side of the first sheet is printed on. Then, a first side of a fourth sheet is printed on, a second side of the second sheet is printed on, a first side of the fifth sheet is printed on, a second side of the third sheet is printed on, a first side of a sixth sheet is printed on, etc. Thus, in this operation of the present invention, two sheets are always in standby positions, one sheet is currently being printed on, and thus there are always at most three sheets within the apparatus in this printing sequence in the present invention.

In the sequence in FIG. 8(*b*), when it is judged that the reading of image data of a second surface of a second sheet will be delayed, for example when the amount of the image data is a lot, the printing sequence changes to printing on the second surface of the second sheet before printing on the first surface of a fourth sheet. The reason for this change is that if the fourth sheet is sent inside to the apparatus to be printed on, as the second sheet is suspended at the first standby position 114 and can not start to be fed to be printed on because of the delay, three sheets would be in the resupplying path 200, i.e., the second sheet, the third sheet, and the fourth sheet. As a result, the fourth sheet could collide with the third sheet and a sheet-jam may occur. To avoid this situation of the fourth sheet possibly colliding with the third sheet, in the present invention the fourth sheet is not fed into the apparatus to be printed on as in the sequence of FIG. 8(*a*), but instead the second side of the second sheet is printed on before the fourth sheet is fed so that printing on the second sheet can then be completed and the second sheet can then be discharged. In this embodiment, if it is judged that the reading image data of the second surface of the third sheet will not be delayed, the printing sequence can then return to the high-speed printing mode.

Figure 9:
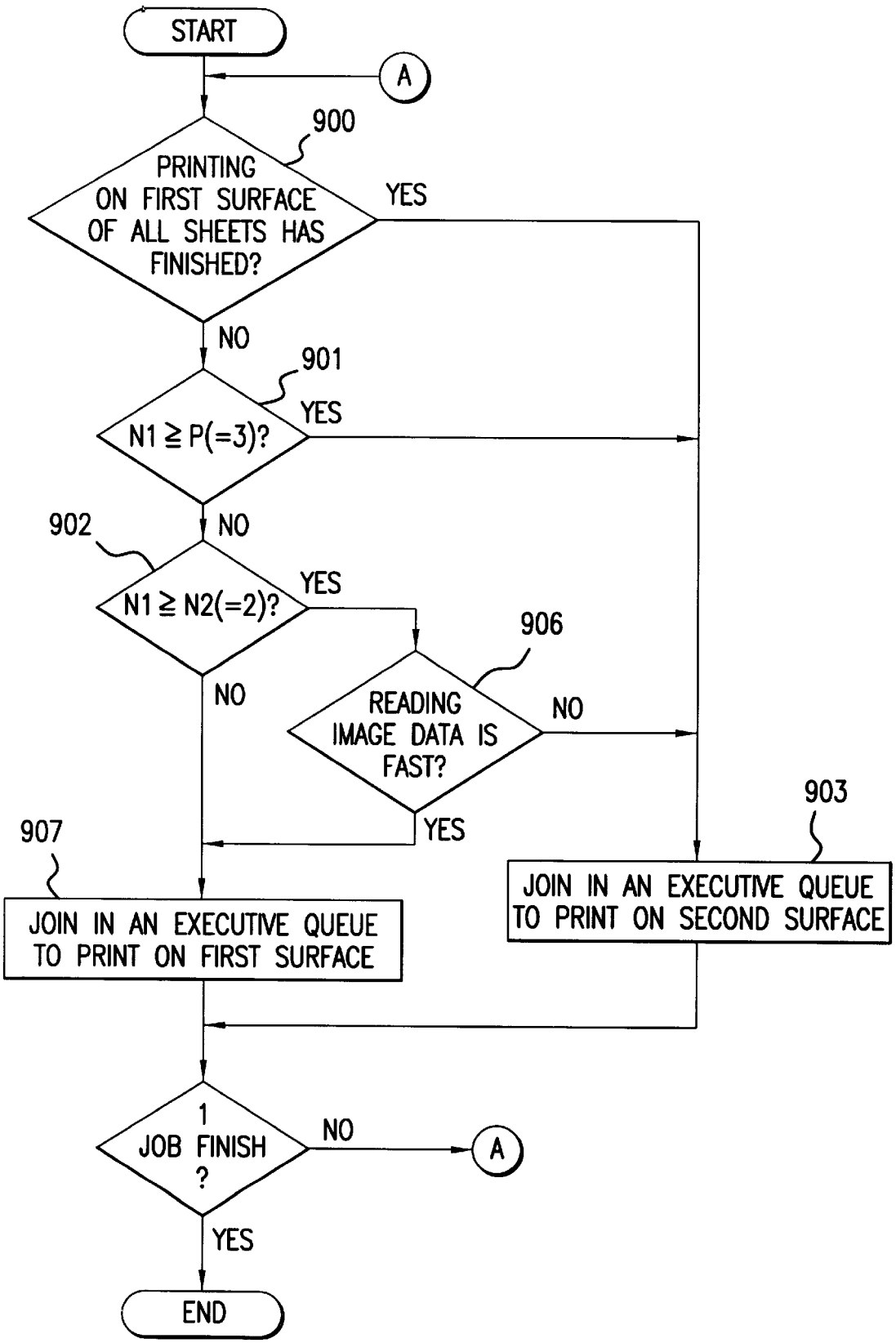
FIG. 9 is a flow chart diagram of determining a printing sequence in an embodiment of the present invention.

FIG. 9 shows a flow chart diagram for determining the printing sequence, that is to say for determining on which surface of which sheet to print on. In FIG. 9, it is first judged whether printing on the first surface of the appropriate number of sheets has finished in step 900. If "YES" in step 900, an operation of printing on the second surfaces of the sheets is joined in an executive queue, and if "NO" in step 900, whether the expression "N1≧P (in this embodiment P=3)", is satisfied is judged step 901. If "YES" in step 901, an operation of printing on the second surfaces is joined in an executive queue, and if "NO" in step 901, whether the expression "N1≧N2 (in this embodiment N2=2)" is satisfied is judged step 902. If "NO" in step 902, an operation of printing on a first surface of an appropriate sheet is joined in an executive queue, and if "YES" in step 902, whether a reading time is fast (normal) is judged in step 906. If "NO" in step 906, an operation of printing on the second surface is joined in an executive queue, and if "YES" in step 906, an operation of printing on the first surface is joined in an executive queue. When all printing sequences regarding a job are determined, this process is finished.

A specific operation in the present invention from an initial printing will now be explained with reference to FIGS. 8(*a*) and 9 and in the embodiment of the present invention.

Prior to a first sheet being printed, there will have been no printing requests made, either for printing on a first surface of a sheet or for printing on a second surface of a sheet, and thereby N1=0. As a result, an operation proceeds from step 900 to step 901, and then to step 902. In step 902, since N1=0, N1 is less than 2, the number 2 represents the number of standby positions (N2) in this embodiment of the present invention. The operation then proceeds to step 907 in which case an operation for printing on a first surface of the first sheet is stored in a queue. At this time this printing request stored in the queue for printing on the first surface of the first sheet results in the value N1 being updated so that N1=1−0 (the zero represents that no requests for printing information on a second surface of any sheet has at this time been stored), i.e., N1=1.

Then, when a second sheet is input for printing, as N1=1, the operation again proceeds through steps 901 and 902, and then proceeds to step 907. At this time the request for printing on the first surface of the second sheet is stored in the queue, and thus there are now two requests for printing on first surfaces of sheets stored in the queue and zero requests for printing on second surfaces of a sheet, and as a result N1=2−0=2.

Then, for a third printing, as N1=2 the operation again proceeds through steps 901 and 902 to step 906. If the reading time for image data is fast, this time in step 907 the queue stores a further request to print on a first surface of the third sheet so that the value N1 now equals 3 (3−0 (the 0 again indicates that no request for printing on a second surface of any sheet have at this time been stored)).

Then, before a fourth printing operation, as N1=3, the operation proceeds from step 901 to step 903. At this time it is determined that the fourth printing operation should be a printing operation of a second surface of the first sheet to avoid having an excessive number of sheets in the printing apparatus (to thereby avoid any potential collision), and this printing request for the second side of the first sheet is then stored in the queue. At this time the value of N1 equals 3 (which is the number of printing requests for printing on first surfaces of sheets stored in the queue) minus 1 (which is the newly issued request for printing on the second surface of the first sheet), and thus N1=(3−1)=2.

In a next printing operation, i.e. a fifth printing operation, as N1=2 the operation proceeds through steps 901, 902 and to step 906, and if the reading time for image data is fast, to step 907 at which it is determined that a next printing operation stored in a queue is a printing on a first surface of a fourth sheet. At this time the value of N1 is then updated to equal 3 (4−1), as at this point there have been four requests for printing on first surfaces of sheets minus the one request for printing on the second surface of the first sheet.

Then, in a sixth printing operation, as again N1=3 the operation proceeds to step 903 at which time the sixth printing is determined to be the second surface of the second sheet, and this printing operation is then also stored in the queue. Again, similarly as noted above, the value of N1 is then updated to equal 2 to reflect the number of printing requests stored for printing on first surfaces of sheets (which is equal to 4) minus the number of requests stored for printing on second surfaces of the sheets (which is 2), i.e., N1=(4−2)=2.

Such an operation of the present invention is clearly reflected in the printing sequence shown in FIG. 8(*a*). Moreover, as noted above, one feature of the present invention is that this sequence of FIG. 8(*a*) can be changed if one sheet is undergoing a long image reading operation, to avoid any situations in which a paper collision may occur, see again FIG. 8(*b*).

With such an operation in the present invention it is possible to adjust a number of sheets in the apparatus to a suitable number timely during a continuous printing action, and as a result a both-sided printing is executed with full efficiency.

A sheet to be printed on next typically stands by the resisting rollers 20 until a writing of the image data on the photosensitive drum 15 starts. However, for example when an irregular operation such as an abnormal decompression or an abnormal transcription of an image data occurs, re-transferring of the image data is attempted, and then a printing timing may be delayed or the re-transferring may not be accomplished well. When the irregular operation occurs after a time, an extra process is usually executed such that a waiting operation for outputting the image data is canceled and the sheet to be printed on is ejected without printing. However, by feeding a greater number of sheets continuously in the resupplying path 200 than the number of standby position(s) in a condition that the waiting time of outputting the image data is prolonged, a sheet may collide with another sheet that is standing by at a standby position, and a sheet jam may occur. Accordingly, to prevent the above-noted problems, as a feature of the present invention when it is judged that the outputting time of the image data is prolonged, the extra process is executed earlier.

Figure 10:
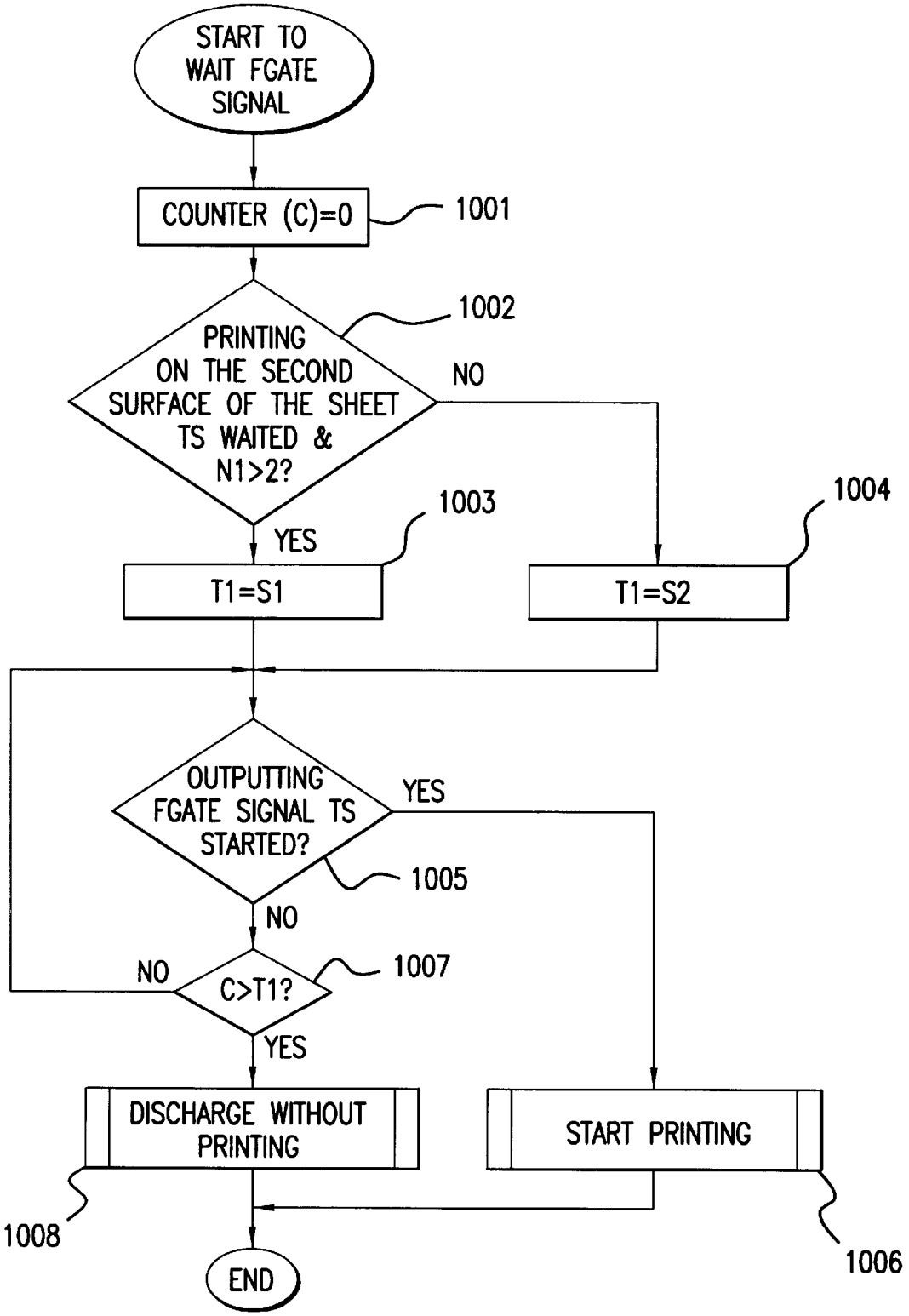
FIG. 10 is a flow chart figure of executing an extra process in the present invention.

FIG. 10 shows a flow-chart diagram of above-mentioned process. In this process, after a sheet starts to be supplied and then reaches a position to be print on, the process waits for the (/FGATE) signal, or to put it another way, the process enters a waiting routine to output image data.

When entering the waiting routine, a value of a counter C is cleared in step 1001. When printing on the second surface of the sheet is waited and the expression "N1>N2" is satisfied in step 1002, a time limit (T1) for waiting for the (/FGATE) signal is set to S1 in step 1003. Likewise, when NO in step 1002, the time limit (T1) is set to S2 in step 1004. A relation between S1 and S2 is "S1<S2".

Then, whether the (/FGATE) signal is output is judged in step 1005. When the (/FGATE) signal is output, "YES" in step 1005, the printing on the sheet starts in step 1006. On the other hand, when the value of the counter C exceeds a value of T1 in step 1007, the sheet is ejected without printing as an extra process step 1008.

As noted above, as the extra process is executed timely and preciously, ease of use in this apparatus is improved.

A further embodiment of the present invention is now explained. As the image forming apparatus itself has a similar construction as in the first embodiment, an overlapping explanation is omitted.

Figure 11:
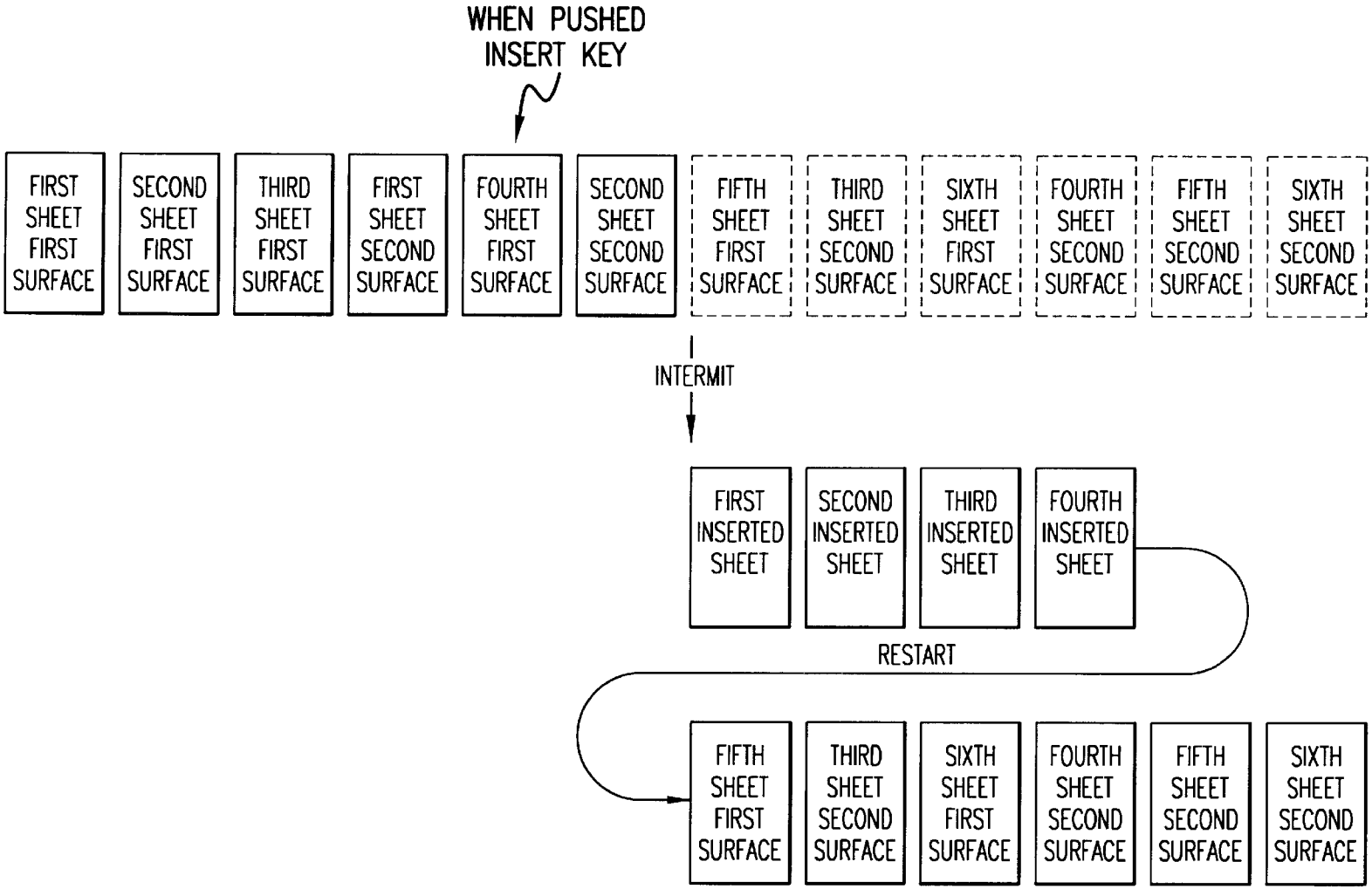
FIG. 11 is an explanation figure showing a both-sided printing sequence in a further embodiment of the present invention.

FIG. 11 is an explanation figure of a both-sided printing sequence in this further embodiment. The number of standby positions (N2: fixed-value) for suspending a sheet to be printed on a reverse side of the sheet are two, see standby positions 114, 115 in FIG. 1. "P (fixed-value)" shows a maximum number of sheets that the apparatus can hold inside, which is three (this includes a sheet currently being printing on) in this embodiment. N1 (a variable value) indicates (a number of printing requests for printing on a first surface of a sheet) minus (a number of printing requests for printing on a second surface of a sheet). A total number of sheets for printing on is again six in this example.

In this printing sequence, values "2" or "3" are basically assigned to the variable "N1" alternately while printing. When a button key for inserting another printing operation into the printing sequence is pushed halfway through the printing operation, a value of "N1" is judged. When "N1" becomes "2", the printing sequence is intermitted and the inserted printing sequence, in this embodiment the number of sheets in this inserted sequence is four, is executed. When this inserted printing sequence has been executed, the former printing sequence is restarted to be executed. In this time, the printing sequence is controlled to have a relation "N1>N2" in order to enhance printing efficiency. To be more specific, a next printing operation is not executed to the sheet suspended in the re-supplying path 200, but to a new sheet for the inserted printing sequence supplied from the sheet supplying device. Therefore, an efficiency of printing on both-sides of a sheet is enhanced and an inserted printing process is executed early and efficiently.

The case has been explained when a key is pushed for inserting another printing operation halfway through a printing sequence. As another case, a case when a facsimile reception is received halfway through a both-sided printing operation in a multifunctional apparatus having a facsimile function, printer function and a copying function can also be considered the same way.

Figure 12:
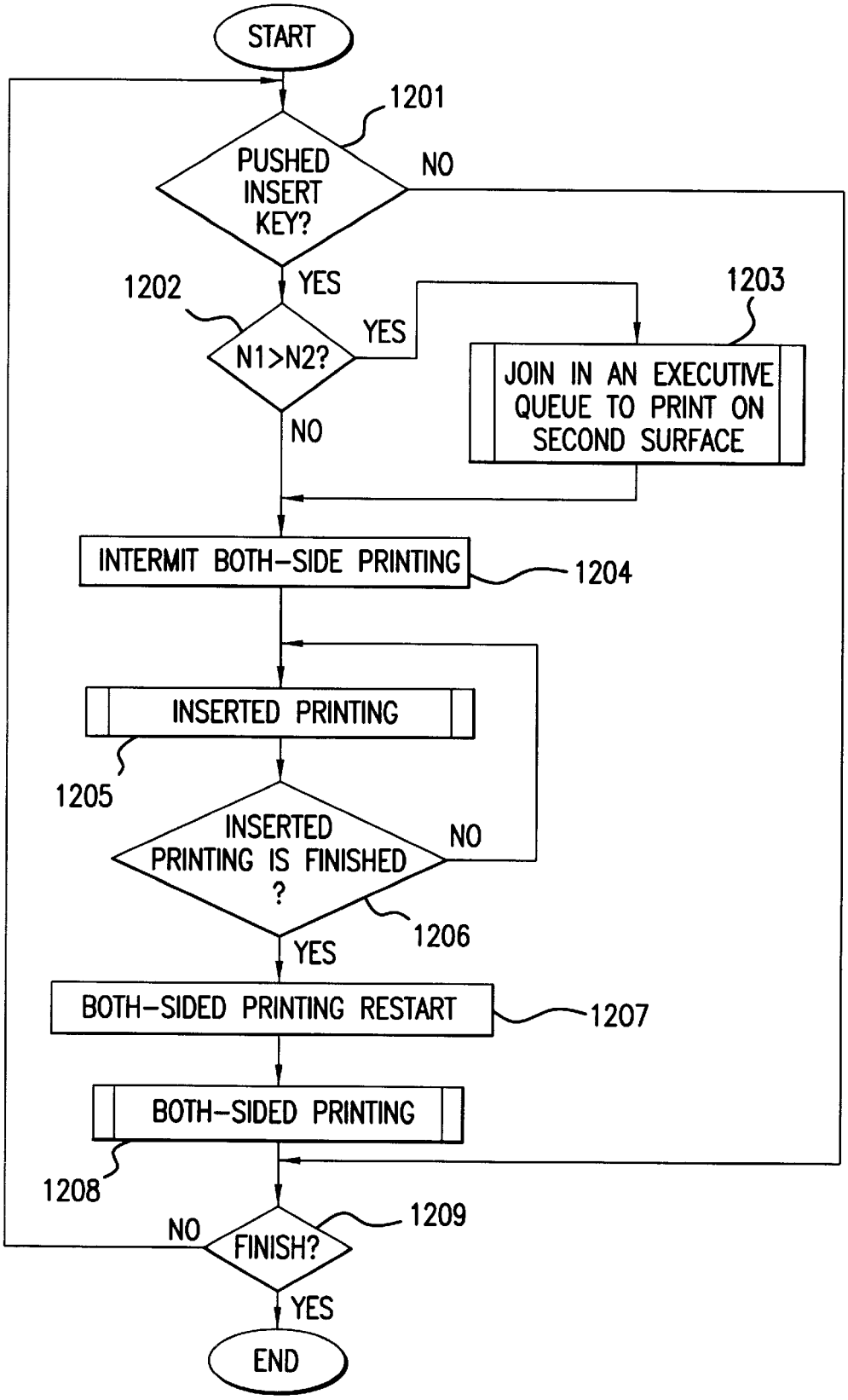
FIG. 12 is a flow chart figure of a process sequence of the both-sided printing sequence shown in FIG. 11 in the present invention.
Figure 13:
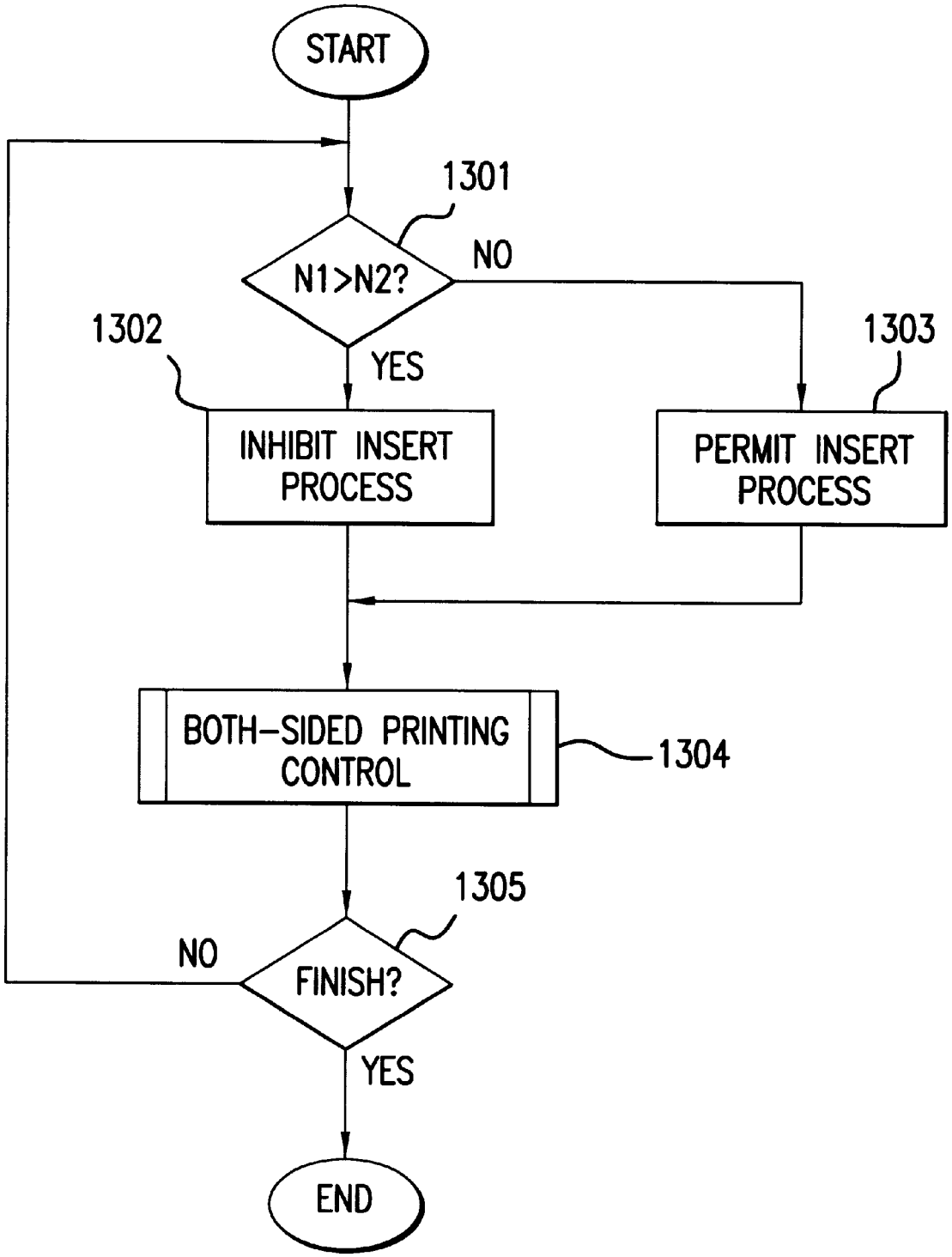
FIG. 13 is a flow chart figure of executing an insert process in the present invention.

This process procedure is explained referring to FIG. 12 and FIG. 13. In FIG. 12 it is first judged whether the insert button key is pushed in step 1201. If the insert key is pushed, "YES" in step 1201, whether a equation "N1>N2" holds is judged in step 1202. When "YES" in step 1202, an operation printing on a next second sheet surface is joined in an executive queue in step 1203, and then a series of printing operations is temporally stopped in step 1204, after the printing joined in the executive queue is executed. When is "NO" in step 1202, the series of printing operations is stopped in step 1204 immediately, or after a current printing operation is finished. The printing operation re-starts to be executed at once after the printing operation inserted by the pushing the insert key has been executed in steps 1205 to 1208. When both the inserted and the both-sided printing jobs have finished in step 1209, this process is finished.

The inserted printing process, as shown in FIG. 13, is controlled between permission and inhibition with reference to the value of "N1". When the equation "N1>N2" holds in step 1301, the inserted printing process is waited until the equation "N1>N2" does not hold in steps 1301 to 1305.

As noted above, as an inserted printing process is inserted during a successive both-sided printing process, both processes are executed with efficiency.

Figure 14A:
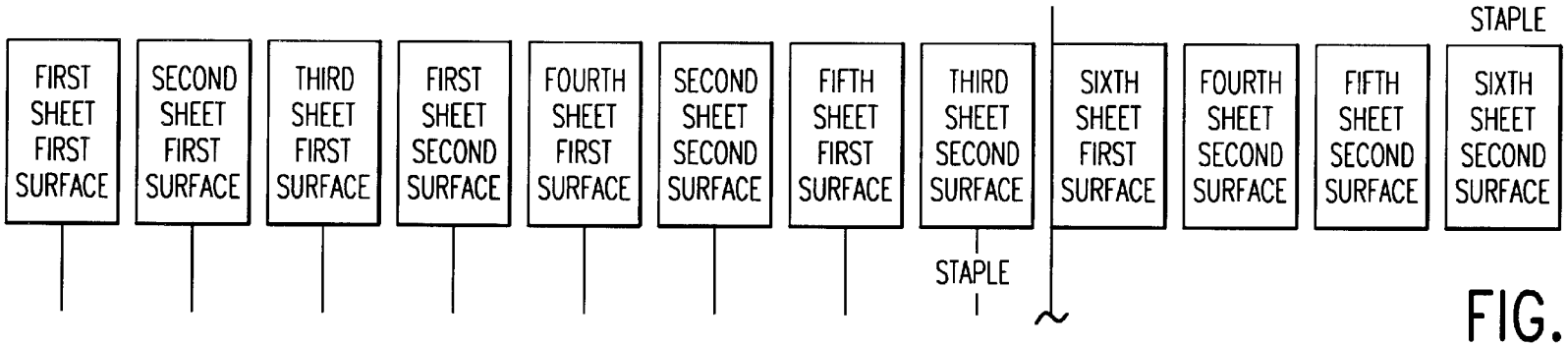
FIGS. 14(*a*) and 14(*b*) are explanation figures showing a both-sided printing sequence in a further embodiment of the present invention.
Figure 14B:
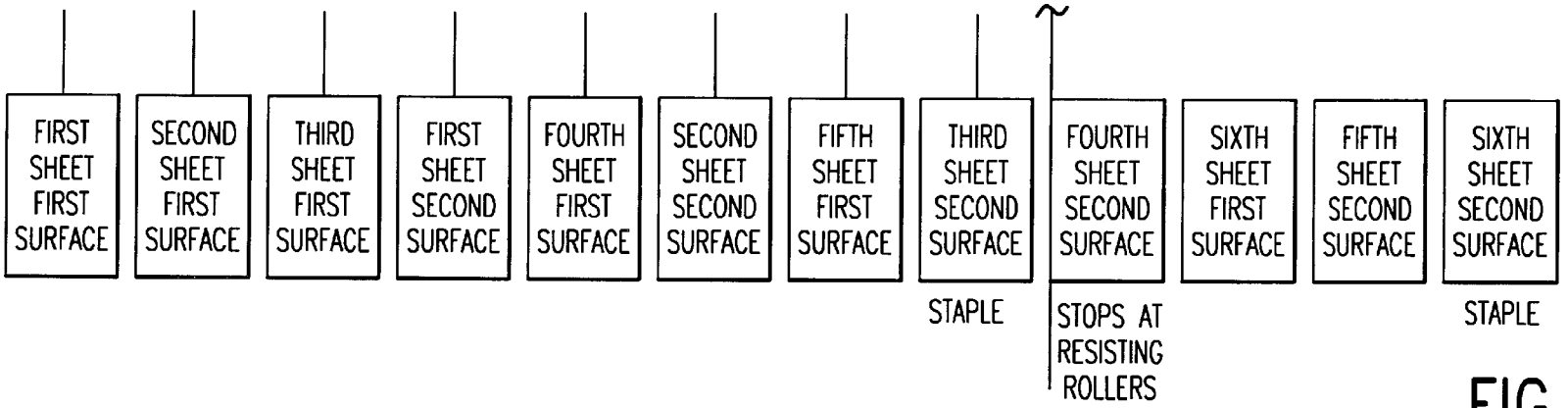

FIG. 14 shows an explanation figure of a both-sided printing sequence in a further embodiment of the present invention having a finishing device.

In this further embodiment of the present invention the number of standby positions (N2: fixed-value) for suspending a sheet to be printed on a reverse side of the sheet are two, see standby positions 114, 115 in FIG. 1. "P (fixed-value)" shows a maximum number of sheets that the apparatus can hold inside, which is three (this includes a sheet currently being printed on) in this embodiment. N1 (a variable value) indicates (a number of printing requests for printing on a first surface of a sheet) minus (a number of printing requests for printing on a second surface of a sheet). A total number of sheets for printing is again six in this example. This apparatus has a finisher 100, as shown in FIG. 15, as a finishing device instead of the discharging tray 19 shown in FIG. 1.

The finisher 100 has two main paths. One path includes feeding rollers 102 and conveyance rollers 103, and the other path includes conveyance rollers 105 and 107. A switchover between these paths is executed by a path selector 101.

A sheet ejected from the discharging unit 18 is lead to a discharging tray 104 through the forward noted path. Similarly, a sheet is lead to a staple tray 108 through the other noted path. Jogger 109 evens up edges of a stack of sheets onto the staple tray 108 every landed sheet, and the sheets are stapled by a stapler 106. The sheets then fall to a tray 110 by gravitation. On the other hand, the discharging tray 104 can move back-and-forth. By moving back-and forth as a unit, sheets can be simply assorted by the unit.

Figure 15:
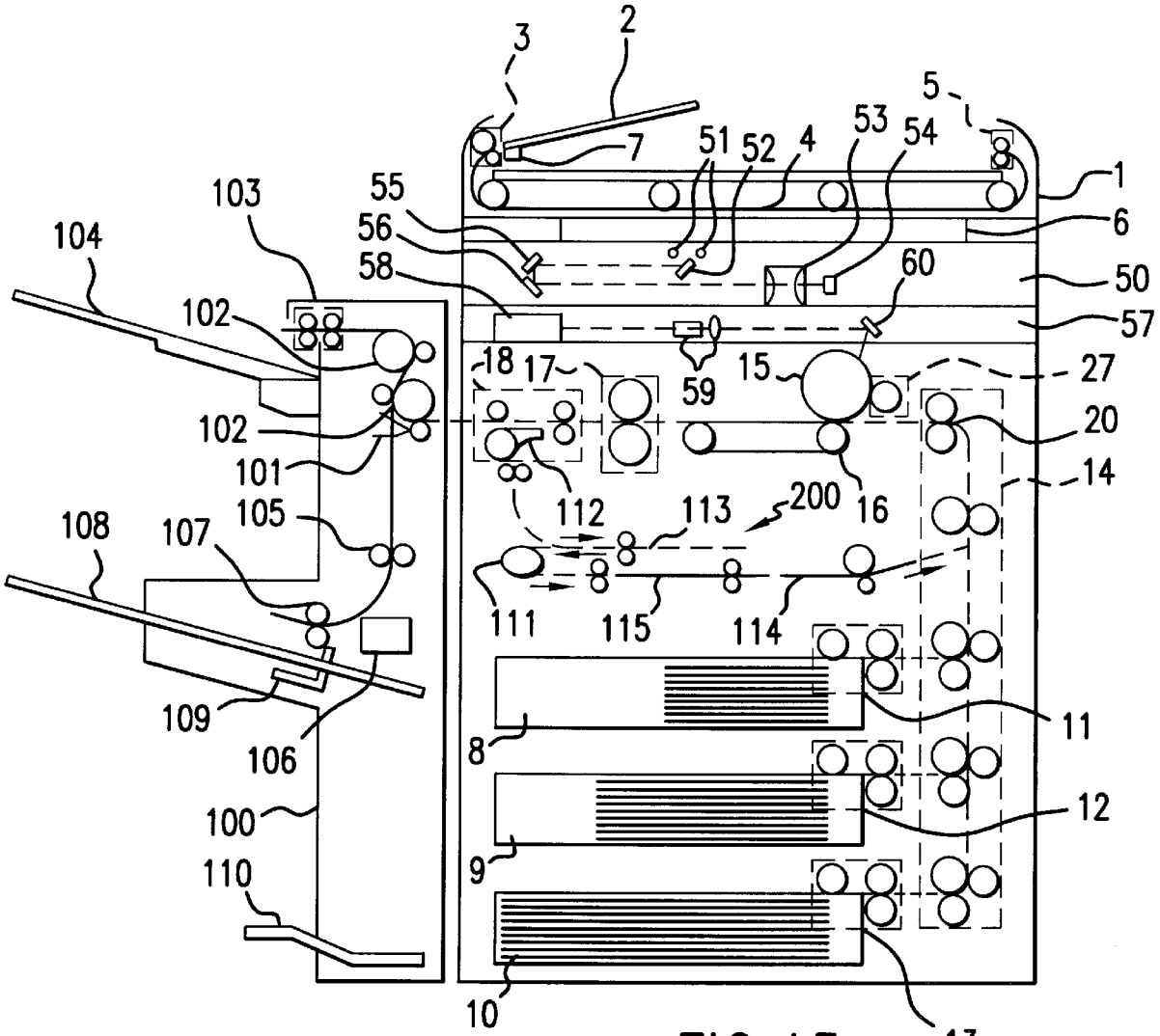
FIG. 15 is an outline construction figure of a further embodiment of the present invention.

In FIG. 15 parts assigned the same numerals as in FIG. 1 are the same parts as in FIG. 1. An overlapping explanation, therefore, is omitted.

As shown in FIG. 14(*a*), a printing operation is executed on a first surface of a first sheet, a second sheet, and a third sheet successively. The printing operation is then executed on a second surface and the first sheet. The first sheet, the second sheet, and the third sheet can then be stapled, after printing on the second surface of the third sheet. Until the stapling operation is finished, a next printing action is delayed and a next sheet to be printed on is made to stand by at the resisting rollers 20. Accordingly, the stapling action is executed reliably. If the printing action is continued without waiting, there is a fear that the sheet that is due to be discharged next will be discharged during stapling.

As a modified embodiment, shown in FIG. 14(*b*), printing on the second surface of the fourth sheet instead of printing on the first surface of the sixth sheet as the next printing operation after the waiting is allowed. Accordingly, this modification has an effect that printing control becomes easier. Because when printing action is executed on the first surface of a next supplied sheet after the waiting, the controller must judge and manage where the sheet will be fed, e.g. to the resupplying path 200 or to the discharging tray 104, in advance of the stapling action. This makes printing control complicated.

On the other hand, when the printing operation is executed on the second surface of the next supplied sheet after the waiting, the sheet is fed to the staple tray 108 with reliability without the judgement.

Figure 16:
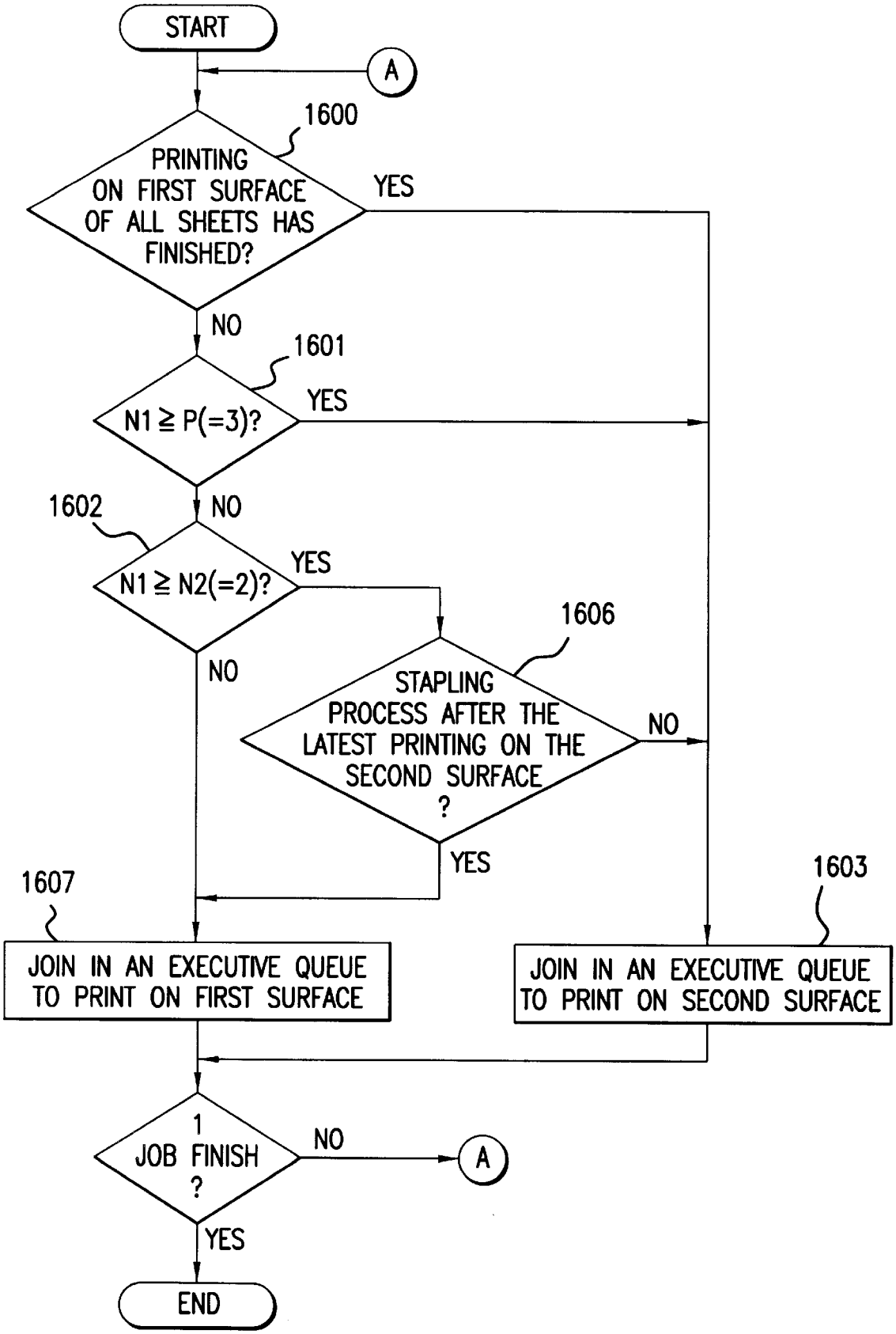
FIG. 16 is a flow chart diagram of determining a printing sequence in an embodiment of the present invention.

FIG. 16 shows a flow chart diagram for determining a printing sequence in this further embodiment of the present invention, that is to say for determining which surface of a sheet is to be printed on in the modified embodiment.

First, it is judged whether printing on the first surface of all the sheets has been finished in step 1600. If "YES" in step 1600, an operation of printing on a next second surface is joined in an executive queue, and if "NO" in step 1600, whether the expression "N1≧P (in this embodiment P=3)" is satisfied is judged in step 1601. If "YES" in step 1601, an operation of printing on a next second surface is joined in an executive queue in step 1603, and if "NO" in step 1601, whether the expression "N1≧N2 (in this embodiment N2=2)" is satisfied is judged in step 1602. If "NO" in step 1602, an operation of printing on a next first surface is joined in an executive queue in step 1607, and if "YES" in step 1602, whether a next process just after the latest printed action on the second surface is for stapling is judged in step 1606. If "NO" in step 1606, an operation of printing on a next second surface is joined in an executive queue, and if "YES" in step 1606, an operation of printing on a next first surface is joined in an executive queue. When all printing sequences regarding the job are determined, this process is finished.

Obviously, numerous additional modifications and variations of the present invention are possible in light of the above teachings. It is therefore to be understood that within the scope of the appended claims, the present invention may be practiced otherwise than as specifically described herein.

I claim:

1. An image forming apparatus comprising:

a memory means for storing image information;

a printing means for printing said image information stored in the memory means onto a first surface and a second surface of sheets with reference to a printing sequence;

a sheet supply means for supplying the sheets to the printing means;

a sheet resupplying means for resupplying sheets on which printing has been executed on the first surface to the printing means;

a resupplying path for guiding the sheets printed on the first surface to the printing means, and the resupplying path having at least one standby position for suspending the sheets, and for suspending plural sheets at respective different standby positions when plural standby positions are present; and a control means for determining whether a value of (a number of printing requests for printing on the first surface of a sheet) minus (a number of printing requests for printing on the second surface of a sheet) is larger than the number of standby positions, and for controlling the printing sequence based on this value.

2. An image forming apparatus according to claim 1, wherein said control means determines said value based on a reading period of said image information from said memory means.

3. An image forming apparatus according to claim 1, wherein said control means monitors a beginning of image outputting from said memory means and an extra process is executed after a beginning of image outputting from said memory means has not been detected within a predetermined time period, wherein said time period is varied.

4. An image forming apparatus according to claim 1, further comprising an insert means for inserting an inserted printing operation during the printing sequence, and wherein an order of executing the inserted printed operation is based on the value and number of standby positions.

5. An image forming apparatus according to claim 1, wherein the number of standby positions is two.

6. An image forming apparatus comprising:

a memory means for storing reading image information;

a printing means for printing said image information stored in the memory means onto a first surface and a second surface of sheets with reference to a printing sequence;

a sheet supplying means for supplying the sheets to the printing means;

a sheet resupplying means for resupplying the sheets after printing has been executed on the first surface of the sheets to the printing means;

a resupplying means for guiding the sheets printed on the first surface to the printing means, and the resupplying means having at least one standby position for suspending the sheets, and for suspending plural sheets at respective different standby positions when plural standby positions are present;

a finishing means for administering a finishing process to sheets printed on both surfaces thereof; and a control means for controlling a first printing operation to print continuously on first surfaces of a number sheets which is greater than the number of the standby positions, and for making a next printing operation wait until an action of the finishing process is finished, during a successive printing operation for printing to plural sheets after said first printing operation.

7. An image forming apparatus according to claim 6, wherein the control means further determines whether a value of (a number of printing requests for printing on the first surface of a sheet) minus (a number of printing requests for printing on the second surface of a sheet) is larger than the number of standby positions.

8. An image forming apparatus according to claim 7, wherein the value is larger than the number of standby positions when said next printing operation is executed.

9. An image forming apparatus according to claim 6, wherein the number of standby positions is two.

10. An image forming apparatus comprising:

a memory storing image information;

a printer printing said image information stored in the memory onto a first surface and a second surface of sheets with reference to a printing sequence;

at least one sheet tray for supplying the sheets to the printer;

a sheet resupply tray resupplying sheets on which printing has been executed on the first surface to the printer;

a resupplying path for guiding the sheets printed on the first surface to the printer, and the resupplying path having at least one standby position for suspending the sheets, and for suspending plural sheets at respective different standby positions when plural standby positions are present; and a controller determining whether a value of (a number of printing requests for printing on the first surface of a sheet) minus (a number of printing requests for printing on the second surface of a sheet) is larger than the number of standby positions, and for controlling the printing sequence based on this value.

11. An image forming apparatus according to claim 10, wherein said controller determines said value based on a reading period of said image information from said memory.

12. An image forming apparatus according to claim 10, wherein said controller monitors a beginning of image outputting from said memory and an extra process is executed after a beginning of image outputting from said memory has not been detected within a predetermined time period, wherein said time period is varied.

13. An image forming apparatus according to claim 10, further comprising an insert unit inserting an inserted printing operation during the printing sequence, and wherein an order of executing the inserted printed operation is based on the value and number of standby positions.

14. An image forming apparatus according to claim 10, wherein the number of standby positions is two.

15. An image forming apparatus comprising:

a memory storing reading image information;

a printer printing said image information stored in the memory onto a first surface and a second surface of sheets with reference to a printing sequence;

at least one tray supplying the sheets to the printer;

a sheet resupplying tray resupplying the sheets after printing has been executed on the first surface of the sheets to the printer;

a resupplying path guiding the sheets printed on the first surface to the printer, and the resupplying path having at least one standby position for suspending the sheets, and for suspending plural sheets at respective different standby positions when plural standby positions are present;

a finishing device administering a finishing process to sheets printed on both surfaces thereof; and a controller controlling a first printing operation to print continuously on first surfaces of a number sheets which is greater than the number of the standby positions, and for making a next printing operation wait until an action of the finishing process is finished, during a successive printing operation for printing to plural sheets after said first printing operation.

16. An image forming apparatus according to claim 15, wherein the controller further determines whether a value of (a number of printing requests for printing on the first surface of a sheet) minus (a number of printing requests for printing on the second surface of a sheet) is larger than the number of standby positions.

17. An image forming apparatus according to claim 16, wherein the value is larger than the number of standby positions when said next printing operation is executed.

18. An image forming apparatus according to claim 15, wherein the number of standby positions is two.

* * * * *